US005310228A

United States Patent [19]

Ellenberg

[11] Patent Number: 5,310,228

[45] Date of Patent: May 10, 1994

[54] SECURITY DOOR BOLTING MECHANISM

[76] Inventor: John F. Ellenberg, 1240 Sunset Ct., Herndon, Va. 22070

[21] Appl. No.: 60,934

[22] Filed: May 13, 1993

[51] Int. Cl.[5] ..... E05C 1/14

[52] U.S. Cl. ..... 292/167; 292/166

[58] Field of Search ..... 292/35, 36, 40, 92, 292/93, 166, 167, 168, 174, 186, 173, 48, 196, DIG. 68, 7, 21, 139

[56] References Cited

U.S. PATENT DOCUMENTS

| | | | |
|---|---|---|---|
| 808,673 | 2/1906 | Morewood | 292/21 |
| 1,007,306 | 10/1911 | Nevins et al. | 292/93 |
| 1,566,321 | 12/1925 | Frantz | 292/167 |
| 1,704,748 | 3/1929 | Kusch | 292/93 |
| 1,831,117 | 11/1931 | Huston | 292/93 |
| 1,842,998 | 1/1932 | Rebischke et al. | 292/93 |
| 1,900,785 | 3/1933 | Ashbrook | |
| 2,752,773 | 7/1956 | Abelson et al. | 292/92 X |
| 3,055,204 | 9/1962 | Pelcin | 292/174 X |

FOREIGN PATENT DOCUMENTS

| | | | |
|---|---|---|---|
| 1026194 | 3/1958 | Fed. Rep. of Germany | 292/168 |

OTHER PUBLICATIONS

Prince Automatic Cremorne Bolt With Panic Release Feature p. 13-Von Duperin Catalogue-Date unknown but acknowledged to be more than one year prior to May 13, 1993.

*Primary Examiner*—Richard E. Moore

*Attorney, Agent, or Firm*—Kerkam, Stowell, Kondracki & Clarke

[57] ABSTRACT

A latch bolt actuating mechanism for a door having a latch bolt mounted on its inner surface adjacent a top edge thereof in position to engage and cooperate with a fixed keeper above the door includes an elongated strap having its top end connected to the latch bolt for vertical movement therewith and its bottom end connected to an actuator pivotally mounted in a rigid housing on the door surface by a removable shaft extending through the housing. The actuator is biased to the closed or latched position and a lever or strike plate extends from the housing in position to be pivoted about the shaft toward and away from the door inner surface with the lever being operable upon movement toward the inner surface to move said strap and the latch bolt connected thereto downwardly to release the latch bolt from the keeper. The rigid housing provides a stop for engaging said lever to limit the pivotal movement of said actuator and the downward movement of the strap.

12 Claims, 3 Drawing Sheets

SECURITY DOOR BOLTING MECHANISM

BACKGROUND OF THE INVENTION

1. Field of the Invention

This invention relates to door bolting and opening mechanisms and more particularly to an improved bolting and opening mechanism for use on doors in areas such as on loading docks or in service corridors where they are subject to heavy use and impact damage.

2. Description of the Prior Art

Doors used in service corridors, on loading docks and other high use service areas are generally of rugged construction to resist damage from repeated impact with service carts, hand trucks, and the like. Typically such doors are of hollow steel construction and are mounted in pairs to provide minimum obstruction to traffic, but frequently are not classified as fire doors which require the conventional panic bar actuator extending across the width of the door for releasing the door latch in order to meet fire codes. Nevertheless, it is conventional to use latch bolts at the top and bottom of the doors, with the latch bolts being operated by vertical actuating rods which, in turn, are actuated by horizontally extending panic bars. The known panic bar actuated latch bolt mechanisms, or door hardware, is not only relatively expensive to manufacture and to install, but is particularly difficult and expensive to maintain.

Because of the difficulty in repairing the prior art service door hardware, it is common practice to simply remove and replace the hardware when it is damaged to the extent that it is no longer functional. Accordingly, it is a primary object of the present invention to provide an improved latch bolt mechanism for security doors which is highly reliable in operation and economical to produce.

Another object of the invention is to provide such a latch bolt actuating mechanism which is highly resistant to damage by impact with service carts, hand trucks and the like.

Another object is to provide such a latch bolt actuating mechanism which is readily accessible and easily and economically maintained.

In the attainment of the foregoing and other objects and advantages of the invention, an important feature resides in providing a latch bolt actuator which can be mounted onto the flat interior surface of a metal door using conventional fasteners such as self-tapping metal screws. A rigid metal housing is mounted directly onto the face of the door, or a reinforcing plate mounted on the door, adjacent the strike style, and an actuation lever is pivotally mounted within the housing for movement about a horizontal axis defined by a removable bolt or shaft. An actuator lever or paddle extends from the housing in position to be depressed toward the door face about the pivotal shaft to actuate the latch bolt, and the rigid housing includes stop means extending beneath the lever in position to engage and stop its movement after a predetermined rotation about the pivotal shaft whereby excess force on the lever is absorbed by the housing and transferred directly to the door without applying excessive stress to the actuating mechanism. The pivoted actuator is connected to a flexible metal strap which extends along the surface of the door and is connected to a conventional latch bolt supported in a guide mounted at the top edge of the door in position to engage a fixed keeper on the top frame or soffit of the door. A spring biased lost motion means is provided in the latch bolt and a cam surface on the latch is positioned to engage the keeper to permit the door to be closed and latched without actuation of the lever. Resilient biasing means is provided in the actuator housing to urge the actuator to the raised position to normally retain the latch bolt in position to engage the keeper when the door is closed.

BRIEF DESCRIPTION OF THE DRAWINGS

The foregoing and other objects and advantages of the invention will be apparent from the detailed description contained hereinbelow, taken in conjunction with the drawings, in which.

DESCRIPTION OF THE PREFERRED EMBODIMENT

Figure 1:
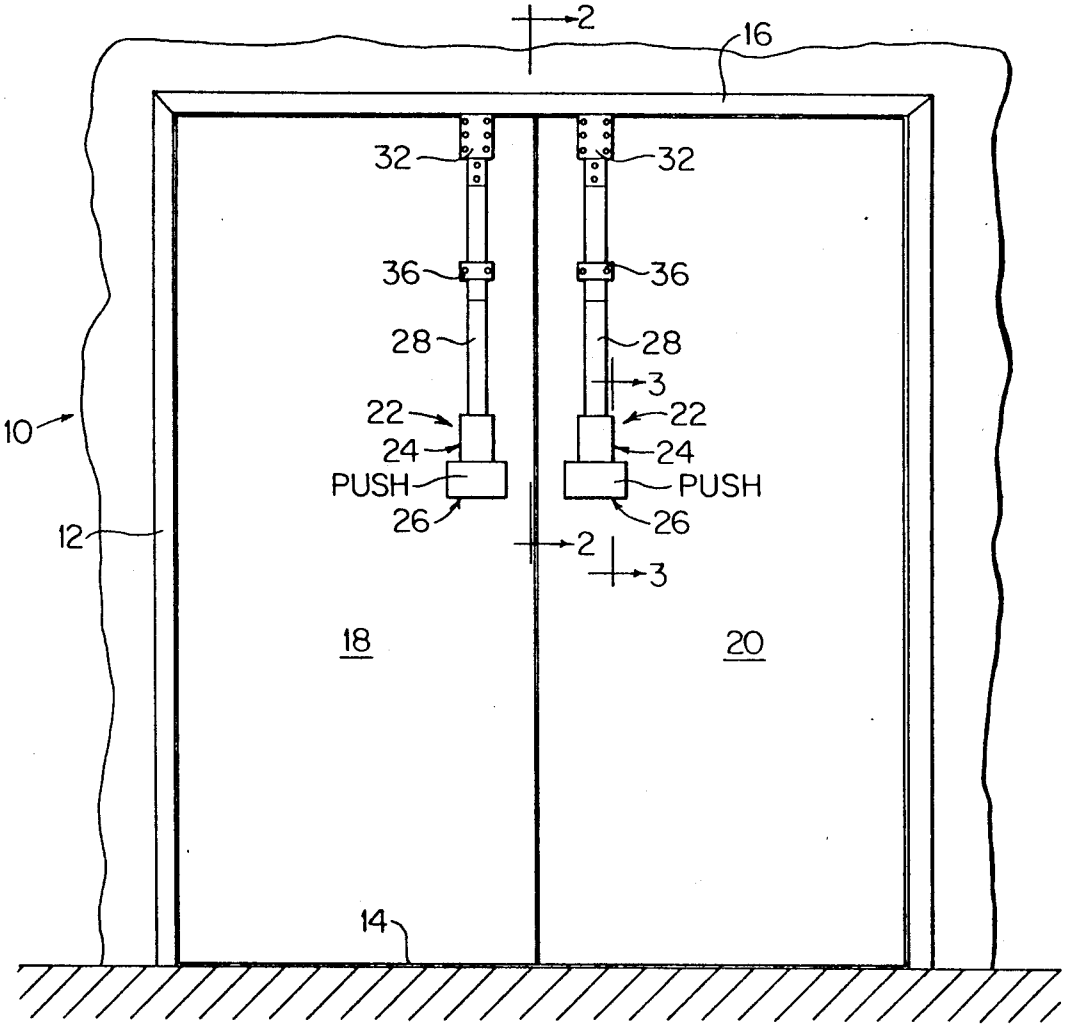
FIG. 1 is an inside elevation view of a double door installation having the door latching mechanism of the present invention installed thereon.

Referring now to the drawings in detail, a double door assembly 10 is illustrated in FIG. 1 and includes a frame 12 including a threshold or sill 14 and overhead plate or soffit 16 defining a door opening and in which doors 18 and 20 are hinged in the conventional manner. A latch bolt actuating mechanism in accordance with the present invention is indicated at 22 as being mounted on the inner surface or face of each door 18, 20 for releasably securing the doors in the closed position shown in FIG. 1.

Figure 2:
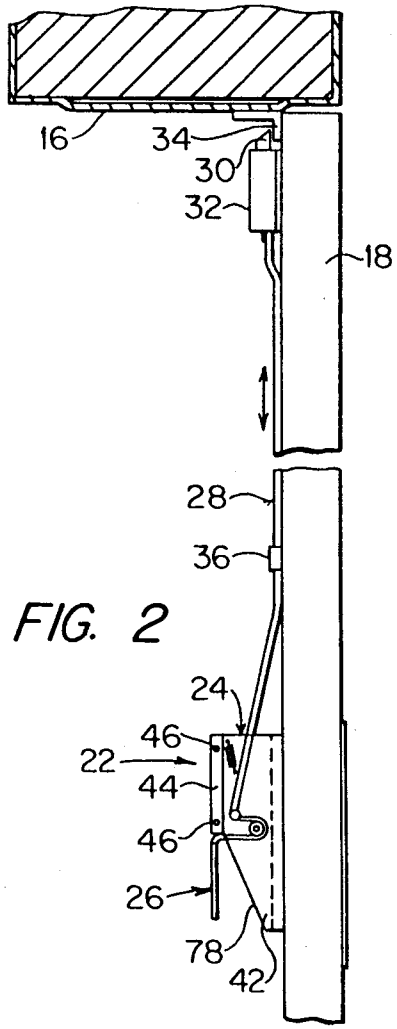
FIG. 2 is an enlarged, fragmentary sectional view taken along 2—2 of FIG. 1.

Referring now to FIG. 2, it is seen that the door latching mechanism comprises a rigid, open ended, box-like metal housing 24 mounted, as by self-tapping screws (not shown) onto the inner surface of door 18 for supporting an actuating lever 26 which is connected, inside the housing 24, to a vertically movable metal strap 28 which extends upwardly along the surface of door 18 and has its top end connected to a vertically movable bolt 30 supported in a latch bolt housing 32. Bolt 30 has a cam surface on its upper end positioned to engage a keeper 34 and be cammed downwardly upon closing the door until the bolt passes behind the keeper 34. An internal spring mechanism of conventional construction (but not shown in the drawings) biases the bolt 30 to the upper or latched position shown in FIG. 2, and is moved downward to disengage the bolt from the keeper 34 by downward movement of the strap 28 in the manner to be described more fully hereinbelow. Guide members 36 extend over strap 34 and are mounted on the face of door 18 to restrain the strap 28 closely adjacent the surface of the door throughout most of its length between the actuator housing 24 and the latch bolt housing 32.

The rigid metal housing 24 consists of a channel-shaped body 38 having a bottom wall 40 and outwardly extending sidewalls 42. A removable top or cover plate 44 is mounted, on housing 24, as by screws 46 extending into sidewalls 42. The housing is removably mounted on the vertical inner surface of door 18 by a plurality of mounting screws, not shown, such as self-tapping sheet metal screws extending through openings 48 in the base or bottom wall 40.

Figure 3:
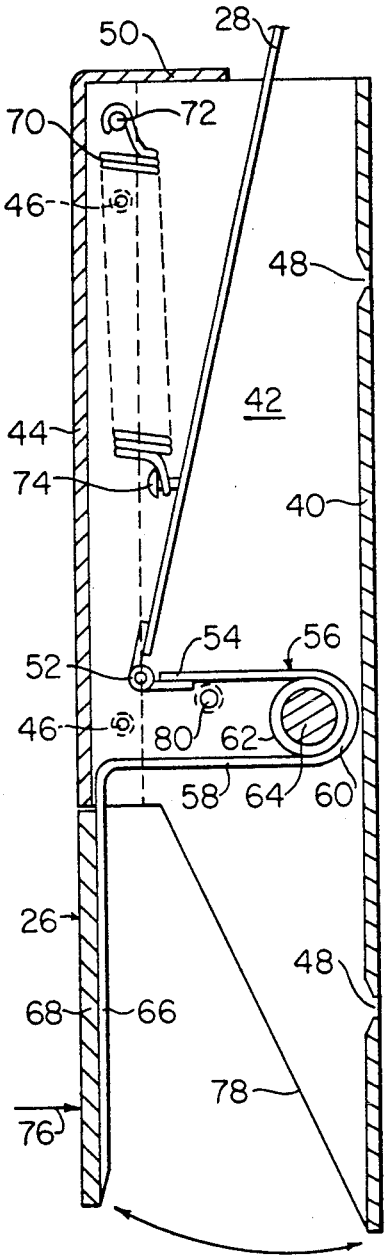
FIG. 3 is a further enlarged fragmentary sectional view taken along line 3—3 of FIG. 1.
Figure 4:
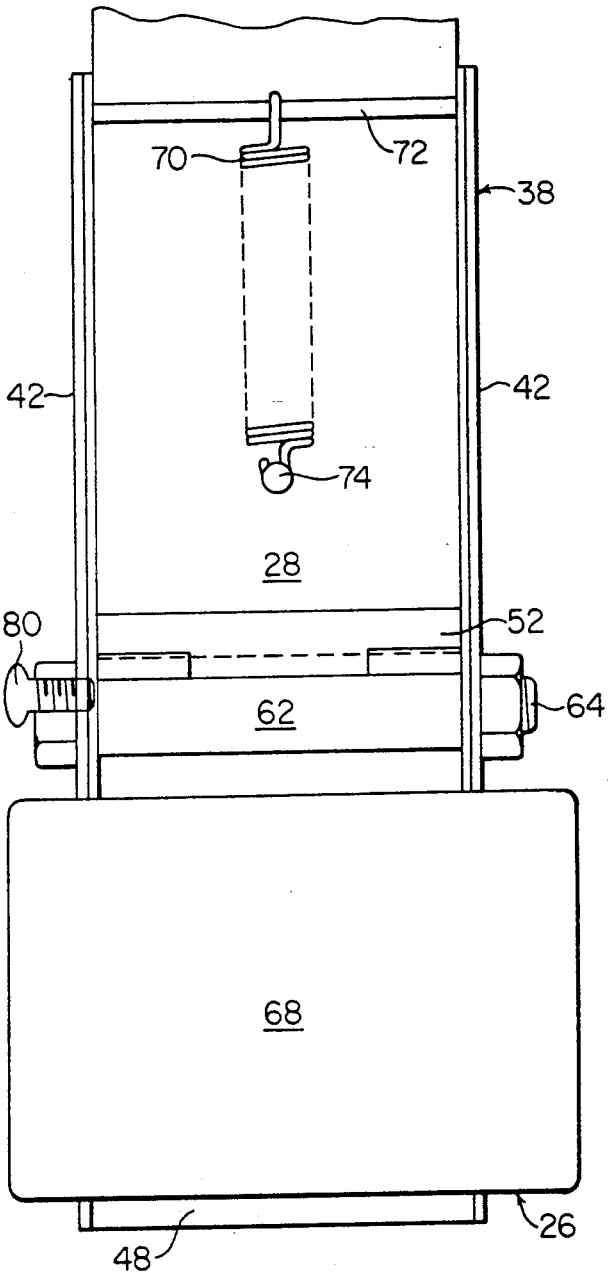
FIG. 4 is an elevation view of the structure shown in FIG. 3, with certain elements omitted to more clearly illustrate other parts.

As best seen in FIGS. 3 and 4, actuating strap 28 extends into the open top end of housing 24 beneath a downturned flange 50 on top cover 44 and has its lower end connected to one leaf of a hinge 52 which, in turn, has its other leaf connected to a horizontally extending arm 54 of an integral mounting bracket portion 56 of actuating lever 26. Mounting bracket 56 includes a second horizontally extending arm 58 integrally joined with arm 54 by a U-shaped portion 60 extending partially around and rigidly welded to a bushing member 62 for receiving a mounting bolt or shaft 64 extending between sidewalls 42 of housing 24. Horizontal arm 58 terminates in a downwardly extending portion 66 having a strike plate 68 rigidly mounted on its outer surface.

As best seen in FIG. 3, the actuating assembly is free to pivot about the bolt 64 and such pivotal movement will result in vertical movement of the strap 28 to actuate the bolt 30. A spring 70 has one end attached to a horizontal pin 72 extending between sidewalls 42 and its other end connected to a mounting pin 74 attached to the surface of strap 28 close to the hinge 52, with spring 70 normally being under tension and applying a load biasing the actuator strap 28 in its vertically uppermost position. In this position, the top edge of strike plate 68 contacts the bottom edge of cover plate 44 to limit pivotal movement of the actuator 56 whereby the plate 68 and cover 44 are normally coplanar. However, force applied to the plate 68 in the direction of arrow 76 will pivot the actuating lever about the horizontal axis of mounting bolt 64 to move the strap 28 downward against the resistance of spring 70 to disengage bolt 30 from the keeper 34 to permit the door to swing open.

The sidewalls 42 of housing 24 extend below the cover plate 42 and have outwardly directed inclined edges 78 in position to engage the bottom surface of the strike plate 68 when the mounting bracket 56 is pivoted about the mounting bolt 64 to thereby form a positive stop limiting this pivotal movement. Since the sidewalls 42 are formed from a relatively heavy steel sheet, the inclined edges 78 provide a high strength support for the strike plate 68 to absorb any excess force applied to the actuating lever and transmit such force directly to the door or reinforcing plate without applying excessive stress to any portion of the movable actuating mechanism. The position of the stop surfaces 78 are such as to engage the under surface of plate 68 before the actuating strap 28 moves the bolt 30 the full extent of its vertical movement so that excessive stress is not applied to the latch bolt mechanism or its mounting to the door surface. Further, since the top cover surface 44 normally extends in a plane parallel to the surface of plate 68, impact with the actuating mechanism by hand carts or the like generally is ineffective to completely actuate the mechanism, whereby the plate 68 generally must be deliberately and manually depressed to actuate the mechanism to open the door. Thus, the rigid housing substantially eliminates the possibility of damage to the actuating mechanism. However, it should be apparent from the construction of the mechanism as described that repairs may be made very expeditiously and inexpensively so that maintenance of the system can be accomplished with minimum time and effort. Further, skilled labor is not required for such maintenance, again reducing the long term cost of the system.

As shown in FIGS. 3 and 4, a simple means for disabling the actuating mechanism may be provided. This disabling means is schematically shown in the form of a thumb screw 80 extending through one sidewall 42 in position to engage the surface of the arm 54 to limit pivotal movement of the actuating lever about the shaft 64. Thus, when it is desired to disable the actuating mechanism as during periods of high use, the strike plate 68 may be depressed into engagement with the surfaces 78 and the thumb screw turned in to engage the top or upwardly directed surface of arm 54, thereby retaining the latch bolt in the lower position so that the doors may be freely opened.

Figure 5:
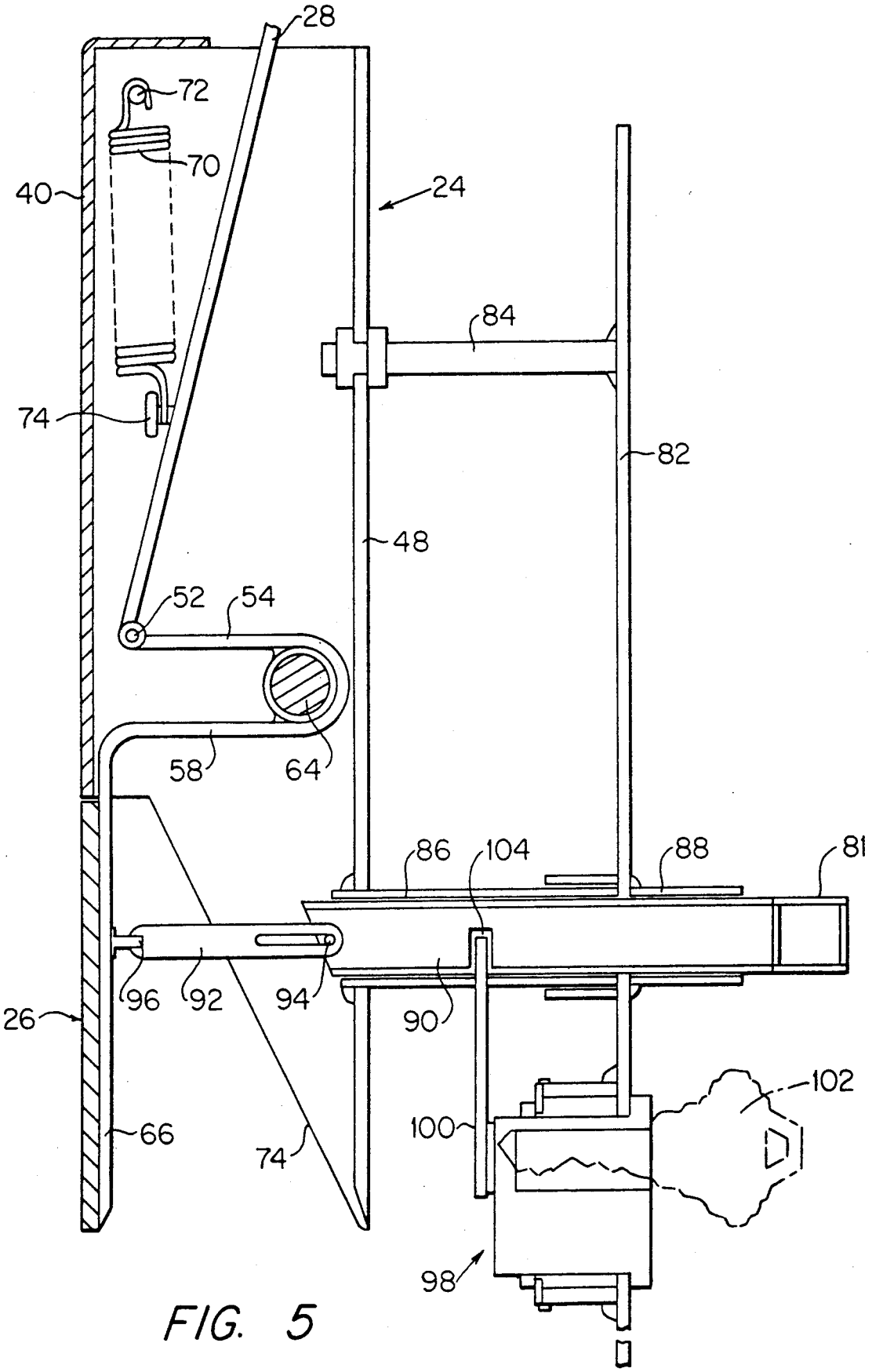
FIG. 5 is a view similar to FIG. 1 and showing an alternate embodiment of the invention.

Referring now to FIG. 5, an alternate embodiment of the invention is illustrated in which a pull handle 81 is provided to enable operation of the actuating mechanism from the side of the door opposite the side on which the actuator is mounted. In this embodiment, a mounting plate 82 is secured to the external surface of the door by suitable means such as mounting studs or spacers 84 adapted to extend through the door and be secured to the bottom wall 40 of the housing 24. A sleeve 86 welded in an opening in bottom wall 40 is dimensioned to extend through an opening in the door and engage the inwardly directed surface of mounting plate 82, and a second sleeve 88 mounted on the outer surface of plate 82 cooperates with sleeve 86 to provide support for a slide shaft 90 of handle 81. A lost motion link 92 is connected through a pin 94 to the shaft 90 and through an eye 96 to the surface of member 66 of the actuating mechanism.

A key actuated lock assembly such as a standard mortise cylinder indicated schematically at 98 is mounted on plate 82 beneath the pull handle 81, and a locking bar 100 actuated by the key 102 is adapted to be projected through a slot in the sleeve 86 and in a slot 104 the shaft 90 to prevent actuation of the mechanism by way of the handle 81 from the outside when desired. Operation of this embodiment from the inside is the same as described above regardless of whether or not the lock 96 is actuated to disable the pull handle.

While I have disclosed and described preferred embodiments of my invention, it should be apparent that modifications may readily be made thereto. For example, the invention is illustrated as being used in conjunction with a double door, but it could also be employed in a single door. Accordingly, it should be understood that I do not intend to be limited by the disclosed embodiment but rather that it is intended to include all embodiments which would be apparent to one skilled in the art and which come within the spirit and scope of the invention.

What is claimed:

1. A latch bolt actuating mechanism for a door having a latch bolt mounted on its inner surface adjacent a top edge thereof in position to engage and cooperate with a fixed keeper above the door, the actuating mechanism comprising, elongated strap means having a top end connected to the latch bolt for vertical movement therewith, said strap means extending downwardly from said latch bolt in juxtaposition to said inner surface of the door and terminating in a bottom end, a rigid metal housing adapted to be releasably mounted on said inner surface of the door, removable cover means mounted on said housing, a bolt actuator connected to said bottom end in said housing, shaft means extending through said housing and supporting said bolt actuator for pivotal movement about a horizontal axis parallel to said inner surface, biasing means in said housing continuously urging said actuator means and said strap means in a direction to engage said latch bolt with said keeper, said actuator including lever means extending from said housing in generally coplanar relationship with said removable cover means and in outwardly spaced relation to said inner surface in position to be pivoted about said shaft means toward and away from said inner surface, said lever means being operable upon movement toward said inner surface to move said strap means and said latch bolt connected thereto downwardly against the force of said biasing means to release the latch bolt from the keeper, and stop means for engaging said lever to limit the pivotal movement of said actuator to thereby limit the extent of downward movement of said strap means and said latch bolt, said stop means including lever engaging surfaces on said rigid metal housing.

2. The latch bolt actuating mechanism defined in claim 1 wherein said cover means includes a surface engaging said lever means to limit pivotal movement of said lever means away from said inner surface.

3. A latch bolt actuating mechanism for a door having a latch bolt mounted on its inner surface adjacent a top edge thereof in position to engage and cooperate with a fixed keeper above the door, the actuating mechanism comprising, elongated strap means having a top end connected to the latch bolt for vertical movement therewith, said strap means extending downwardly from said latch bolt in juxtaposition to said inner surface of the door and terminating in a bottom end, a rigid metal housing adapted to be releasably mounted on said inner surface of the door, said housing including a rigid metal channel having a bottom surface adapted to be mounted on said door inner surface, a pair of parallel laterally spaced sidewalls, and a removable cover mounted on said sidewalls and extending over said channel, a bolt actuator connected to said bottom end in said housing, shaft means extending through said housing and supporting said bolt actuator for pivotal movement about a horizontal axis parallel to said inner surface, biasing means in said housing continuously urging said actuator means and said strap means in a direction to engage said latch bolt with said keeper, said actuator including lever means extending from said housing in outwardly spaced relation to said inner surface in position to be pivoted about said shaft means toward and away from said inner surface, said lever means being operable upon movement toward said inner surface to move said strap means and said latch bolt connected thereto downwardly against the force of said biasing means to release the latch bolt from the keeper, and stop means for engaging said lever to limit the pivotal movement of said actuator to thereby limit the extent of downward movement of said strap means and said latch bolt, said stop means including lever engaging surfaces on said rigid metal housing.

4. The latch bolt actuating mechanism defined in claim 3 wherein said sidewalls includes a portion extending downwardly below said cover means, said downwardly extending portion including edge surface means positioned to engage said lever means to limit pivotal movement thereof toward said inner surface.

5. The latch bolt actuating mechanism defined in claim 4 further comprising hinge means connected to said actuator and to said strap bottom end within said housing.

6. The latch bolt actuating mechanism defined in claim 5 wherein said pivot shaft means comprises a bolt extending through said sidewalls, whereby the bolt actuator may be removed from said housing by removing said bolt.

7. The latch bolt actuating mechanism defined in claim 6 wherein said cover means and said lever means normally extend in substantially coplanar relation.

8. The latch bolt actuating mechanism defined in claim 1 further comprising lever operating means mounted on the outer surface of the door, said lever operating means including handle means adapted to be manually grasped and moved relative to the door, and coupling means extending through the door, said coupling means being connected to said handle means and to said lever, said coupling means being operable to move said lever towards said inner door surface upon movement of said handle means relative to the door.

9. The latch bolt actuating mechanism defined in claim 8 wherein said coupling means comprises guide means extending through the door, and shaft means movably mounted in said guide means, said shaft means and having one end connected to said handle means for movement therewith, and linkage means connecting the other end of the shaft means to said lever, said linkage means including lost motion means permitting movement of said lever to release the latch bolt by depressing the lever toward the inner surface of the door without movement of said handle means.

10. The latch bolt actuating mechanism defined in claim 9 wherein said shaft means is mounted for sliding movement within said guide means in a direction perpendicular to the inner and outer surfaces of the door, said handle means being mounted on the outer end of the shaft for sliding movement therewith towards and away from the outer surface of the door.

11. The latch bolt actuating mechanism defined in claim 10 further comprising key actuated lock means for releasably locking said shaft means against movement in said guide means.

12. The latch bolt actuating mechanism defined in claim 11 wherein said housing comprises a rigid metal channel having a bottom surface adapted to be mounted on said door inner surface and a pair of parallel, laterally spaced sidewalls, said sidewalls each including a portion extending downwardly below said cover means, said downwardly extending portion including edge surface means positioned to engage said lever means to limit pivotal movement thereof toward said inner surface.

* * * * *